United States Patent [19]

Yoneda et al.

[11] Patent Number: 5,030,992

[45] Date of Patent: Jul. 9, 1991

[54] DEVICE FOR REMOVING ELECTROSTATIC CHARGE IN IMAGE FORMING APPARATUS

[75] Inventors: Shinsaku Yoneda, Kashihara; Masami Shibahara, Sakai, both of Japan

[73] Assignee: Mita Industrial Co., Ltd., Osaka, Japan

[21] Appl. No.: 608,751

[22] Filed: Nov. 5, 1990

[30] Foreign Application Priority Data

Nov. 7, 1989 [JP] Japan ..... 1-289095

[51] Int. Cl.[5] ..... G03G 21/00

[52] U.S. Cl. ..... 355/218; 355/219

[58] Field of Search ..... 355/210, 219, 218, 215, 355/227; 219/216; 361/212, 214

[56] References Cited

U.S. PATENT DOCUMENTS

| | | | |
|---|---|---|---|
| 4,534,641 | 8/1985 | Gilliland et al. | 355/218 |
| 4,837,598 | 6/1989 | Nonami | 355/218 |
| 4,837,599 | 6/1989 | Ohira et al. | 355/218 |
| 4,864,364 | 9/1989 | Ogino et al. | 355/218 X |
| 4,928,142 | 5/1990 | Kloosterman | 355/218 |
| 4,974,021 | 11/1990 | Takemoto | 355/219 |

*Primary Examiner*—Arthur T. Grimley
*Assistant Examiner*—Sandra L. Hoffman
*Attorney, Agent, or Firm*—Beveridge, DeGrandi & Weilacher

[57] ABSTRACT

Improvements in a device for removing the electrostatic charge on a photoconductor in an image forming apparatus. The electrostatic charge-removing device has a plurality of light-emitting diodes (LEDs) incorporated in a case. The LEDs emit diffuse light to the photoconductor to remove the electrostatic charge. The LEDs are regularly spaced from each other in a orthogonal direction to a movement direction of the photoconductor in such a way that the successive diffuse light radiations emitted from the neighboring LEDs overlap with each other. The brightness is considerably higher in the locations where the diffuse light radiations overlap with each other than in the other locations. Light-blocking members are mounted upstream of their respective light radiations as viewed in the movement direction of the photoconductor, for uniforming the brightness of light in the orthogonal direction to the movement direction of the photoconductor. This evens out the image erasure line.

10 Claims, 5 Drawing Sheets

DEVICE FOR REMOVING ELECTROSTATIC CHARGE IN IMAGE FORMING APPARATUS

BACKGROUND OF THE INVENTION

1. Field of the Invention

The present invention relates to a device which is used in an image forming apparatus such as an electrostatic process copying machine, laser printer, or facsimile machine to remove the electrostatic charge on a photoconductor.

2. Description of the Prior Art

In a conventional image forming apparatus of one kind, an electrostatic charge-removing device is installed ahead of the developing device as viewed in the movement direction of the photoconductor to remove the electrostatic charge in a desired region on the photoconductor before the development process. As an example, where a margin is formed around the front end of the paper to prevent it from being wound around the photoconductor, the electrostatic charge on that portion of the photoconductor which corresponds to this front end portion is removed. Where a document is copied excluding its one part or a part of a document is copied, i.e., so-called edited development is performed, the electrostatic charge in the desired portion on the photoconductor is removed. Also, electrostatic charge is removed from the unwanted image region that is placed outside the receiver paper, for preventing consumption of excessive toner.

The electrostatic charge-removing device is normally composed of light-emitting diodes regularly spaced from each other in a orthogonal direction to the movement direction of the photoconductor in a case. One example of such an array of light-emitting diodes (LEDs) is shown in FIG. 7, and each LED produces diffuse light. The diffuse light emitting from each LED draws a substantially square form on the surface S of the photoconductor. The characteristics of the brightness are such that it is highest in the center of the light and decreases toward the around area of the light. The distance by which the neighboring LEDs are spaced from each other is so determined that the successive diffuse light radiations emitted from the neighboring LEDs overlap partially with each other.

The case has light width-limiting portions 8*a* extending along the photoconductor 1, to define the width of the cross section of the diffuse light that is emitted from the LEDs 9 toward the photoconductor surface S. Therefore, the electrostatic charge on the surface S is removed within this width. However, in the locations d where the successive diffuse light radiations emitted from the neighboring LEDs 9 overlap with each other, the brightness is too intense and the light will reach the image area beyond the width defined by the width-limiting portions 8*a*. As a result, the light erases some of the necessary electrostatic charge, thus producing notches e in the final print. That is, the boundary between the image area and the non-image area is uneven slightly. Consequently, a part of the required image is lost.

SUMMARY OF THE INVENTION

It is a main object of the present invention to provide an electrostatic charge-removing device which is simple in structure, forms a non-image region sharply, and prevents any desired image from being lost at all.

The above object is achieved in accordance with the teachings of the invention by an electrostatic charge-removing device comprising a plurality of lamps emitting diffuse light and light-blocking members. The lamps are regularly spaced from each other in a orthogonal direction to a movement direction of a photoconductor in such a way that the successive diffuse light radiations emitted from the neighboring lamps overlap partially with each other. The light-blocking members are installed upstream of the light radiations as viewed in the movement direction of the photoconductor to block partially the overlapping light radiations.

The brightness in the locations where the diffuse light radiations overlap with each other is prevented from becoming too intense. This makes uniform the brightness of the diffuse light in the direction of array of the lamps. Hence, the boundary line between the area from which electrostatic charge is removed and the area in which electrostatic charge is left can be rendered even.

Other objects and features of the invention will appear in the course of the description thereof which follows.

DETAILED DESCRIPTION OF THE PREFERRED EMBODIMENTS

Figure 2:
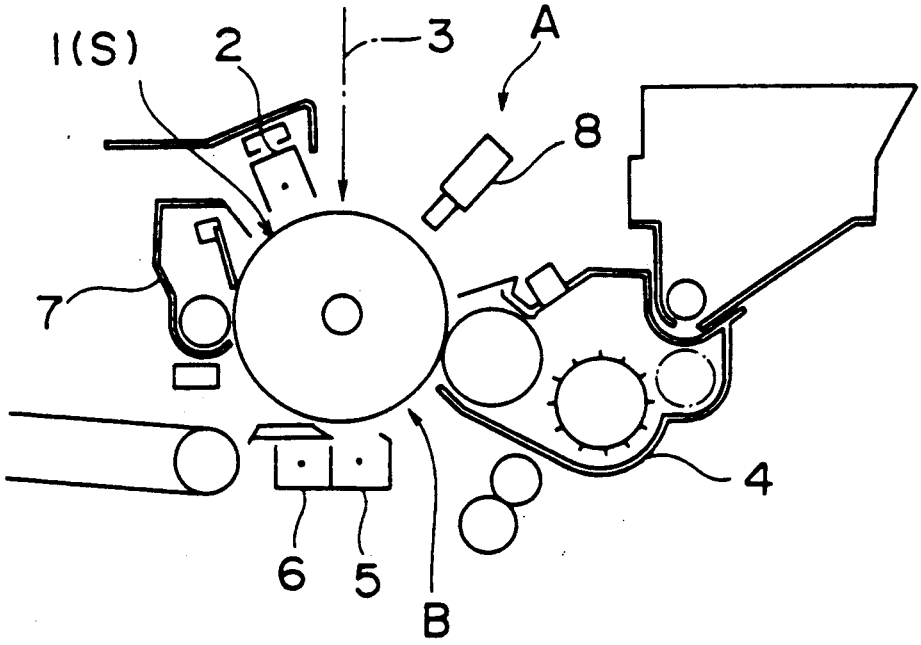
FIG. 2 is a side elevation of main portions of a copier with which the electrostatic charge-removing device shown in FIG. 1 is used.

Referring to FIG. 2, there is shown the image-creating portion B of an electrostatic process copying machine that is one example of an image forming apparatus. The image-creating portion B comprises a photoconductor drum 1 (photoconductor) whose surface has a photoconductive layer and peripheral devices disposed in order around the drum 1, i.e., an electrically charging device 2, an exposure device (not shown in FIG. 2), an electrostatic charge-removing device A, a developing device 4, a transfer device 5, a paper-separating device 6, and a cleaning device 7. Light emitted from the exposure device (not shown) is indicated by numeral 3. An electrostatic latent image is created on the photoconductor drum 1 by the light 3 from the exposure device. The electrostatic charge carried by the latent image is selectively removed by the electrostatic charge-removing device A until the image reaches the developing device 4.

Figure 1:
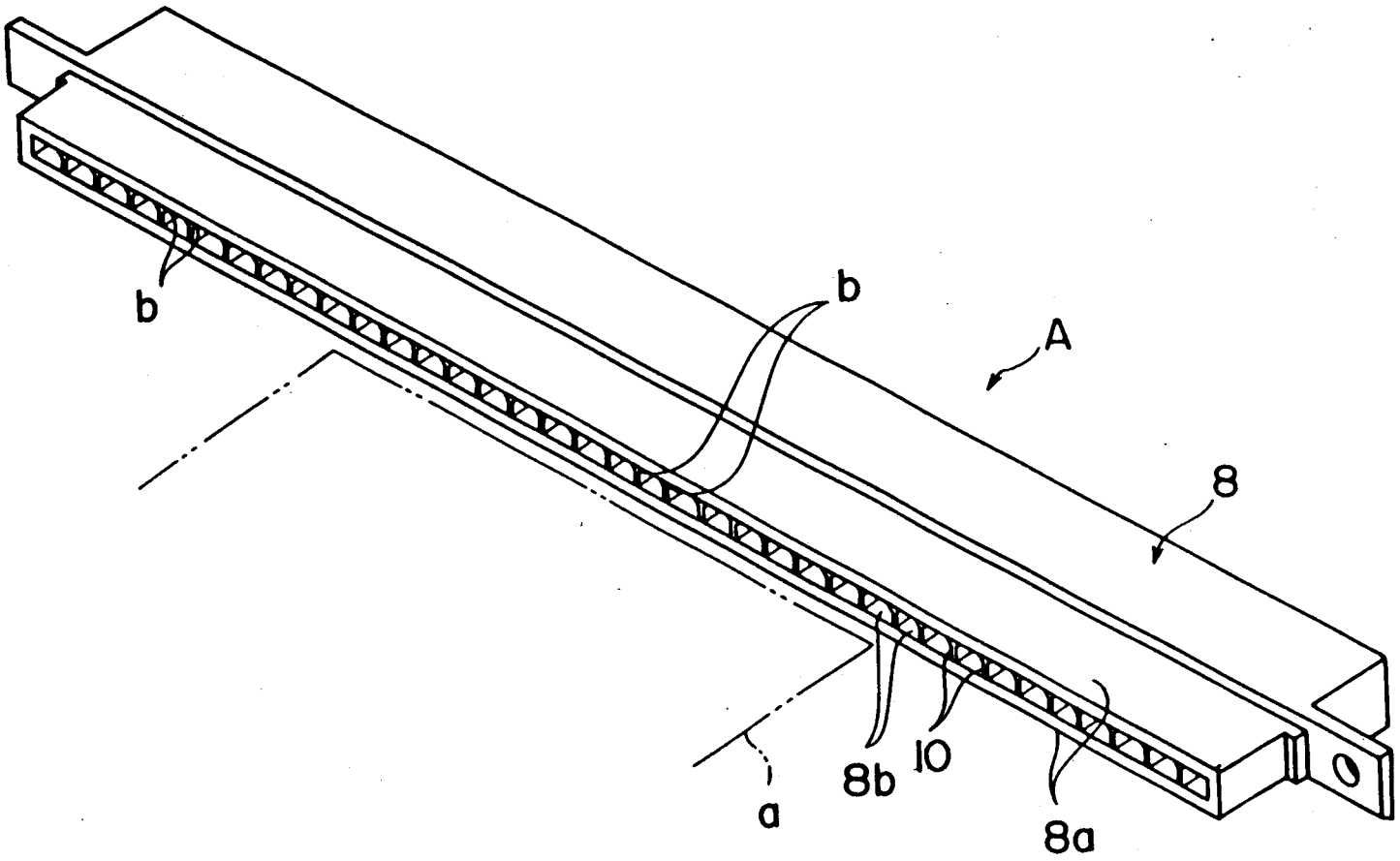
FIG. 1 is a perspective view of an electrostatic charge-removing device according to the invention.
Figure 3:
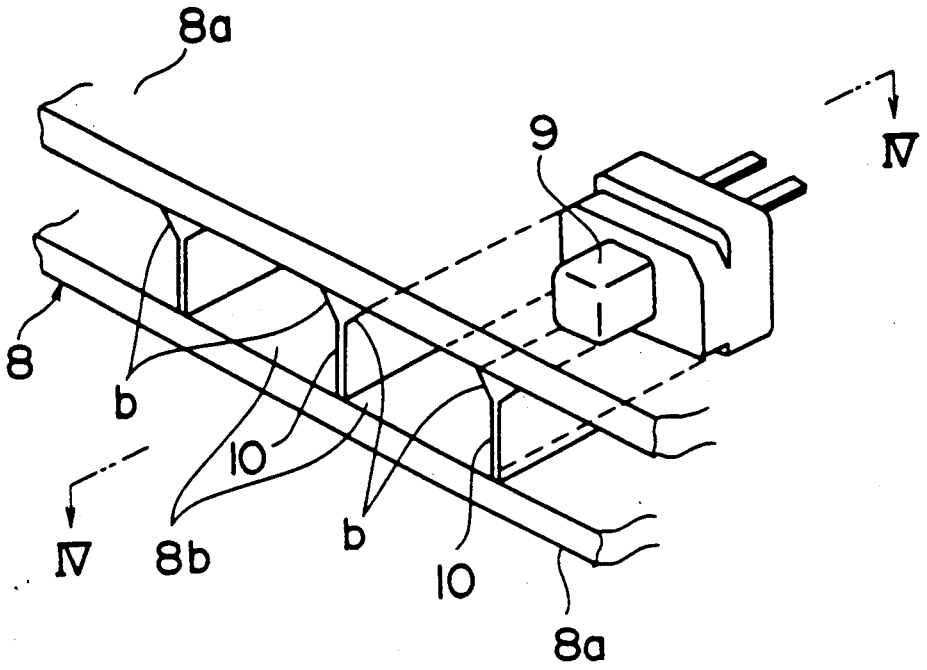
FIG. 3 is a partially cutaway perspective view of the electrostatic charge-removing device shown in FIG. 1.
Figure 4:
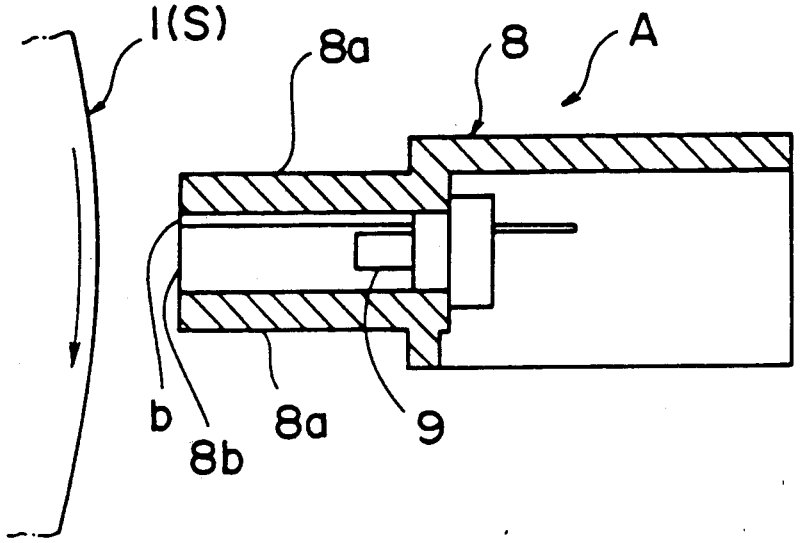
FIG. 4 is a cross-sectional view taken on line IV—IV of FIG. 3.

The electrostatic charge-removing device A is next described in detail by referring to FIGS. 1, 3–5. FIG. 1 is a perspective view of the removing device A which is capable of illuminating the photoconductor drum 1 over its full width, i.e., its full axial dimension. More specifically, the removing device A comprises a case 8 incorporating a multiplicity of lamps 9. The case 8 is provided with openings 8*b* which face the drum 1 and extend axially (i.e. in the orthogonal direction to the movement direction) of the drum 1, as shown in FIG. 4. The width of the cross section of the light radiation leaving each opening 8*b* is determined by a pair of light width-limiting portions 8*a*. In particular, the limiting portions 8*a* extend axially of the drum 1 and are spaced a given distance from each other along the drum 1. The inside of the case 8 is partitioned into parts by partition members 10. As shown in FIG. 3, each lamp 9 is installed between the neighboring partition members 10. The electrostatic charge on the surface S of the photoconductor can be removed by lighting up the lamps 9.

Figure 5:
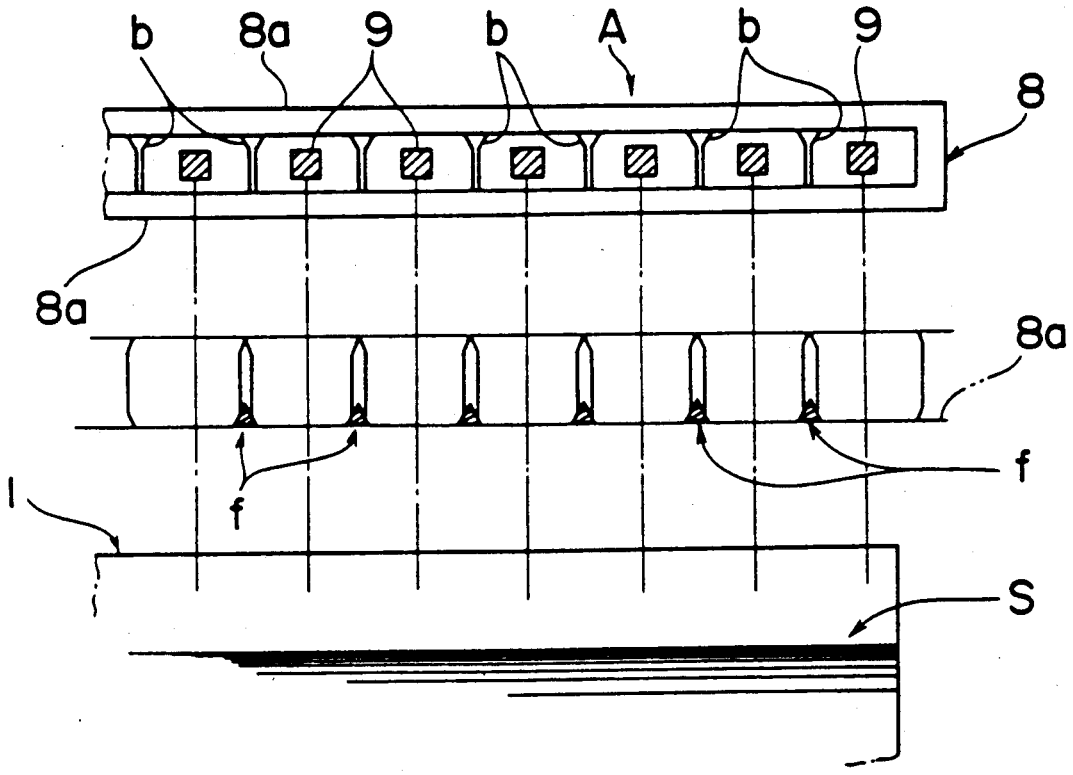
FIG. 5 is a view for illustrating the principle of removal of electrostatic charge, when the electrostatic charge-removing device shown in FIG. 1 is used.

Referring to FIG. 5, each lamp 9 consists of a light-emitting diode (LED), for example. The light emitted from each lamp 9 is substantially square in cross section. The distribution of the brightness of the light on the photoconductor surface S is such that the brightness is highest in the center of the illuminated portion and decreases toward both ends. That is, the light is diffuse light. The plural lamps 9 are equally spaced from each other axially of the drum 1 in such a way that the successive light radiations emitted from the adjacent lamps 9 overlap partially with each other. The width of the cross section of the diffuse light emitted from each of the lamps 9, i.e., the dimension of the illuminated portion on the drum surface taken in the direction of rotation of the drum 1, is determined by the light width-limiting portions 8*a*. The dimension of the illuminated portion on the surface of the drum 1 taken axially of the drum 1 is determined by the partition members 10.

In the above-described structure, the electrostatic charge can be selectively removed by controlling the timing at which the lamps 9 are lit up, the time for which they are lit up, and the lit region. As an example, if all the lamps 9 are lit up, the electrostatic charge is removed over the full width of the photoconductor surface S. A margin can be formed around the front end of the paper a (FIG. 1) by removing electrostatic charge from that portion of the photoconductor surface S which corresponds to the margin. The image is transferred to the paper a.

Wasteful consumption of toner in the image area outside the width of the paper a is prevented by lighting up the lamps 9 corresponding to the undesired area so as to remove electrostatic charge from the undesired image area.

Also, so-called edited development can be performed. In particular, an image of a document is developed with its one part erased by selectively lighting up the lamps 9 for a given time. Conversely, only a part of the image of a document is developed by selectively putting out them for a given time.

The electrostatic charge-removing device A described above is further provided with light-blocking members b to partially block the light at the locations where the successive light radiations emitted from the successive lamps overlap with each other. The blocking members b are located upstream of the light radiations as viewed in the direction of rotation (i.e. the movement direction) of the drum 1 and partially intercept the diffuse light projected onto the drum 1. In this way, the brightness on the upstream side can be suppressed to some extent at the locations where the light radiations overlap with each other.

In the example shown in FIGS. 1, 3–5, the light-blocking members b are formed at the locations where the light width-limiting portion 8*a* of the case 8 that is located on the upstream side as viewed in the direction of rotation of the drum 1 (in the illustrated example, the upper one of the light width-limiting portions 8*a*) are in contact with the partition members 10. In this example, the blocking members b are formed integrally with the upstream portions of the partition members 10. The blocking members b are triangular in shape.

In this construction, the upstream portions of the overlapping portions of the light radiations emitted from the neighboring lamps 9 are intercepted by their respective light-blocking members b, as shown in FIG. 5, where the intercepted areas are hatched and indicated by f. In these areas, the brightness of the light is reduced. Therefore, the brightness in the overlapping portions of the light is suppressed somewhat by appropriately setting the size and the shape of the light-blocking members b. Thus, the brightness in the overlapping portions can be made equal to the brightness in the remaining portions. In other words, the brightness can be made uniform in the direction of array of the lamps. This makes it possible to smooth out the boundary line between the region from which electrostatic charge is removed and the region in which electrostatic charge is left. Consequently, the possibility that intense light reaches even the image area to thereby create notches in the final image can be prevented with certainty, unlike in the prior art techniques.

In the above example, the light-blocking members b are formed integrally with the upstream portions of the partition members 10. The light-blocking members b may be formed integrally with the upstream one of the light width-limiting portions 8*a* of the case 8. Alternatively, the blocking members b are formed independently and installed between the upstream light width-limiting portion 8*a* of the case 8 and the upstream portions of the partition members 10.

Figure 6:
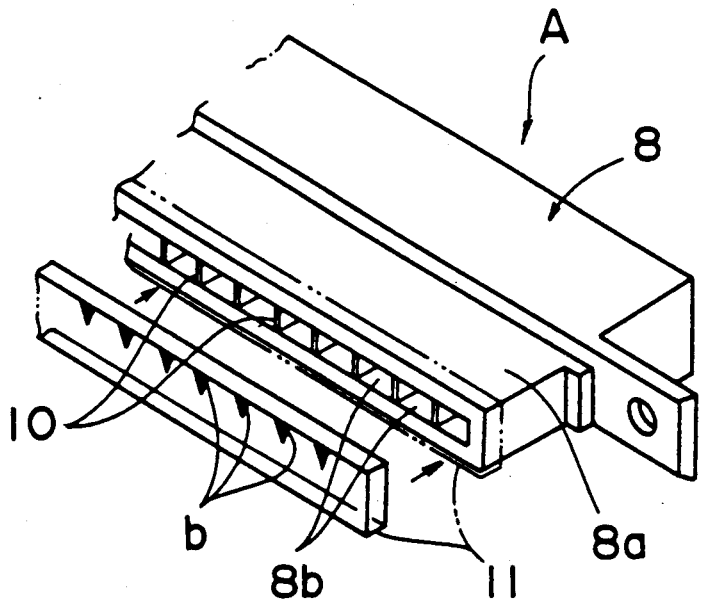
FIG. 6 is a fragmentary perspective view of another electrostatic charge-removing device according to the invention.
Figure 7:
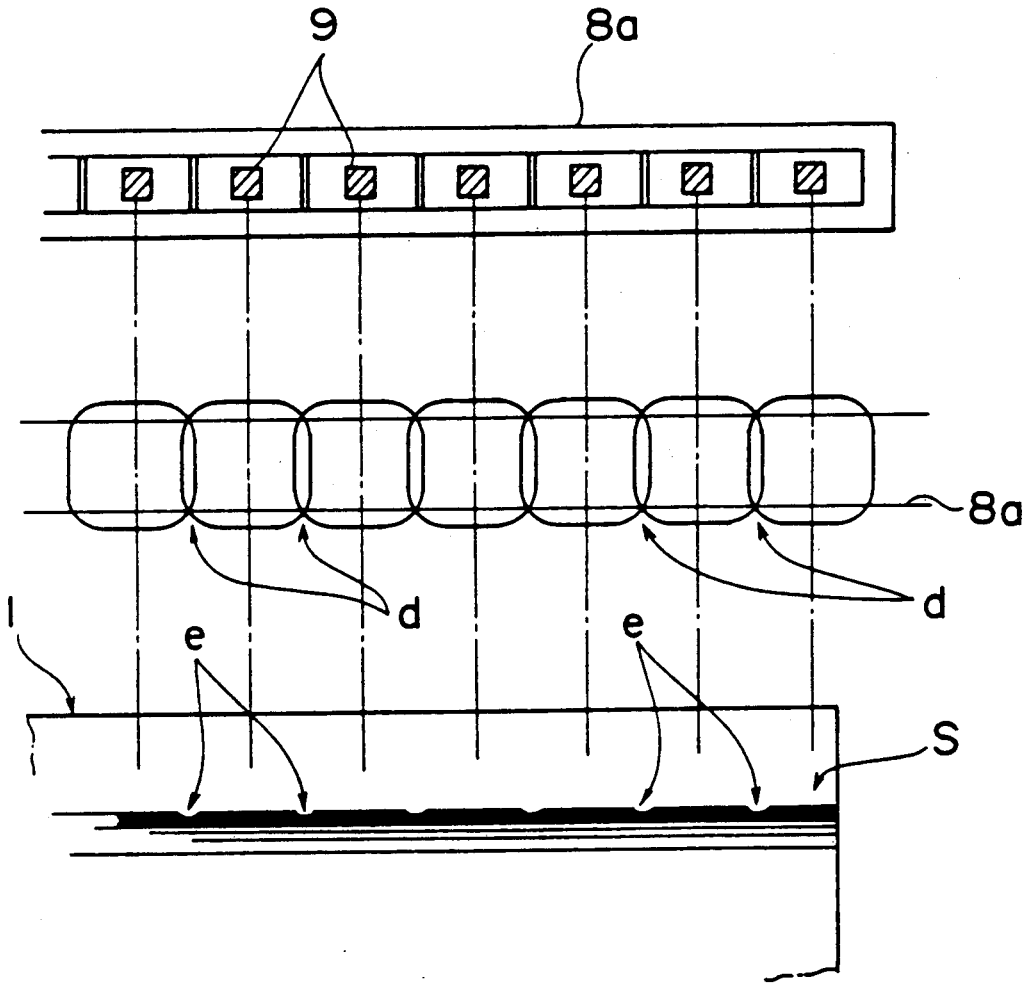
FIG. 7 PRIOR ART
FIG. 7 is a view for illustrating the disadvantage of the prior art electrostatic charge-removing device.

Referring next to FIG. 6, there is shown another electrostatic charge-removing device according to the invention. This charge-removing device is similar to the device already described except that the openings 8*b* in the case 8 is covered by a transparent dustproof cover 11 made from polycarbonate, for example, and that each light-blocking member b is shaped into a black triangle on the cover 11 by silk screen printing or other method. Also in this example, the blocking members b are so formed as to partially intercept the light on the upstream side as viewed in the direction of rotation of the photoconductor drum 1. In this example, the provision of the light-blocking members b permits the image erasure line to be evened out in the same way as in the previous example. Furthermore, the cover 11 prevents the lamps 9 from getting fouled with floating toner particles. In addition, the light-blocking members b are easy to fabricate, because they are formed on the cover 11 by silk screen printing.

What is claimed is:

1. A device for removing electrostatic charge on a photoconductor in an image forming apparatus, comprising:

a plurality of lamps for emitting diffuse light radiations regularly spaced from each other in an orthogonal direction to a movement direction of the photoconductor such that successive diffuse light radiations emitted from the neighboring lamps overlap with each other; and light-blocking members for blocking the overlapping light radiations, the light-blocking members being installed upstream of their respective light radiations as viewed in a movement direction of the photoconductor.

2. The device of claim 1, further comprising a case surrounding said lamps and partition members installed between the neighboring lamps, wherein said case has portions extending in the orthogonal direction to the movement direction of the photoconductor and acting to limit width of each of the diffuse light radiations, and said light-blocking members are disposed at points where at least one of said light width-limiting portions of the case intersects said partition members or vicinities of said points.

3. The device of claim 2, wherein said light-blocking members are formed integrally with upstream portions of the partition members.

4. The device of claim 3, wherein each of said light-blocking members is triangular in shape.

5. The device of claim 4, wherein each of said lamps comprises a light-emitting diode.

6. The device of claim 5, wherein said device is installed ahead of a developing device as viewed in the movement direction of the photoconductor.

7. The device of claim 2, wherein said light-blocking members are integral with an upstream one of the light width-limiting portions of the case.

8. The device of claim 2, wherein said light-blocking members are formed independently and located between an upstream one of the light width-limiting portions of the case and upstream portions of the partition members.

9. The device of claim 2, further comprising a transparent dustproof cover which is integral with said light-blocking members.

10. The device of claim 9, wherein said light-blocking members are formed on the cover by silk screen printing.

* * * * *